US005907340A

United States Patent [19]

Katakura et al.

[11] Patent Number: 5,907,340

[45] Date of Patent: May 25, 1999

[54] LAMINATED INK JET RECORDING HEAD WITH PLURAL ACTUATOR UNITS CONNECTED AT OUTERMOST ENDS

[75] Inventors: Takahiro Katakura; Kazumi Kamoi; Satoshi Shinada, all of Nagano, Japan

[73] Assignee: Seiko Epson Corporation, Tokyo, Japan

[21] Appl. No.: 08/681,376

[22] Filed: Jul. 23, 1996

[30] Foreign Application Priority Data

Jul. 24, 1995 [JP] Japan ..... 7-208397

[51] Int. Cl.[6] ..... B41J 2/045

[52] U.S. Cl. ..... 347/71; 347/70

[58] Field of Search ..... 347/68–72, 43

[56] References Cited

U.S. PATENT DOCUMENTS

| | | | |
|---|---|---|---|
| 4,730,196 | 3/1988 | van Esdonk et al. | 347/71 |
| 4,937,597 | 6/1990 | Yasuhara et al. | 347/71 |
| 5,463,412 | 10/1995 | Matsuda | 347/43 |

FOREIGN PATENT DOCUMENTS

| | | | |
|---|---|---|---|
| 2125250 | 4/1995 | Canada | B41J 2/135 |
| 0572230 | 12/1993 | European Pat. Off. . | |
| 0584823 | 3/1994 | European Pat. Off. . | |
| 0600743 | 6/1994 | European Pat. Off. . | |
| 0648607 | 4/1995 | European Pat. Off. . | |
| 0659562 | 6/1995 | European Pat. Off. . | |
| 0659562A2 | 6/1995 | European Pat. Off. . | |
| 5261918 | 12/1993 | Japan . | |
| 6234218 | 8/1994 | Japan | B41J 2/045 |

*Primary Examiner*—Benjamin R. Fuller
*Assistant Examiner*—C. Dickens
*Attorney, Agent, or Firm*—Sughrue, Mion, Zinn, Macpeak & Seas, PLLC

[57] ABSTRACT

An actuator unit for a laminated ink jet recording head includes: a first cover member for forming a vibrating member having piezoelectric vibrators on a surface thereof; a spacer for forming pressure generating chambers with a surface thereof sealed by the first cover member; a second cover member having ink jetting outlets and ink flowing inlets, each ink jetting outlet causing the corresponding pressure generating chamber to communicate with a corresponding nozzle opening of a flow path unit at one end of the pressure generating chamber, each ink flowing inlet causing the corresponding pressure generating chamber to communicate with a common ink chamber of the flow path unit at the other end of the pressure generating chamber. The actuator unit is prepared by laminating and fixing the first cover member, the spacer and the second cover member. A pitch at which the pressure generating chambers are arranged is set to a value equal to or smaller than a pitch at which the nozzle openings are arranged; widths of partition walls on outermost ends of pressure generating chambers located on the outermost ends are set to a value equal to or greater than a width of a partition wall defining adjacent pressure generating chambers and equal to or smaller than ½ of the nozzle opening arrangement pitch. An increase in the distance between the adjacent pressure generating chambers at the contact line between two actuator units is set to within a range of values substantially equal to the width of the partition wall.

10 Claims, 10 Drawing Sheets

LAMINATED INK JET RECORDING HEAD WITH PLURAL ACTUATOR UNITS CONNECTED AT OUTERMOST ENDS

BACKGROUND OF THE INVENTION

1. Field of the Invention

The invention relates to an actuator unit for a laminated ink jet recording head and a method of fabricating such an actuator unit. The actuator unit has piezoelectric vibration elements, expandable and contractible pressure generating chambers, ink flowing inlets, and ink jetting outlets, and is adapted to construct a recording head while being laminated on a flow path unit having common ink chambers and nozzle openings formed therein.

2. Description of the Related Art

For example, as disclosed in Unexamined Japanese Patent Publication No. Hei. 6-40035, an ink jet recording head, in which piezoelectric vibration elements are stuck to one region of a resilient plate that constitute pressure generating chambers and in which ink droplets are produced by changing the volume of each pressure generating chamber while causing the corresponding piezoelectric vibration element to be flexibly displaced, is designed to displace a wide area of the pressure generating chamber. Therefore, the ink droplets can be produced stably.

In order to improve the printing speed of such a recording head, attempts have been made to arrange a great number of nozzle openings per recording head. Since a head having a great number of nozzle openings has an extremely low yield, it is also designed to use a plurality of actuator units A, B, C and fix such actuator units in zigzag to a flow path unit D having nozzle openings and common ink chambers formed therein as shown in FIG. 11.

However, for a color printing recording head that requires at least three rows of nozzle openings, not only the width of the recording head is increased, but also ink jetting timing control becomes complicated since the positions of the nozzle openings that are driven to print an identical row of data are shifted in a carriage moving direction mutually.

SUMMARY OF THE INVENTION

The invention has been made in view of the aforementioned problems. An object of the invention is therefore to provide an actuator unit for a laminated ink jet recording head that can be arranged straight in a paper feeding direction in pluralities.

A second object of the invention is to provide a laminated ink jet recording head using the aforementioned actuator unit.

A third object of the invention is to provide a method of fabricating the actuator unit.

According to the present invention, there is provided an actuator unit for a laminated ink jet recording head, a plurality of actuator units being brought into contact with each other at ends thereof and laminated on a flow path unit including nozzle openings, comprising: a first cover member having piezoelectric vibrators on the surface thereof; a spacer for forming pressure generating chambers, one surface thereof being sealed by the first cover member; and a second cover member laminated on the spacer and having ink jetting outlets communicating with one end of the pressure generating chambers and ink flowing inlets communicating with the other end of the pressure generating chambers; wherein a pitch at which the pressure generating chambers are arranged is set equal to or less than a pitch at which the nozzle openings are arranged and the width of partition walls on an outermost ends of the pressure generating chambers located at the outermost ends of the actuator is set equal to or more than a width of a partition wall defining adjacent pressure generating chambers and equal to or less than ½ the nozzle opening arrangement pitch.

The distance between two pressure generating chambers that interpose the contact line of the two actuator units merely increases by a value substantially equal to the width of the partition wall that defines the pressure generating chambers. Therefore, the nozzle openings that are to communicate with these pressure generating chambers come to be arranged at least at positions corresponding to the pressure generating chambers. Hence, by slightly staggering the nozzle communication holes of the flow path unit that connect the pressure generating chambers to the corresponding nozzle openings, the two actuator units can be connected under such flow path conditions as to allow ink droplets to be jetted.

DETAILED DESCRIPTION OF THE PREFERRED EMBODIMENTS

Figure 1:
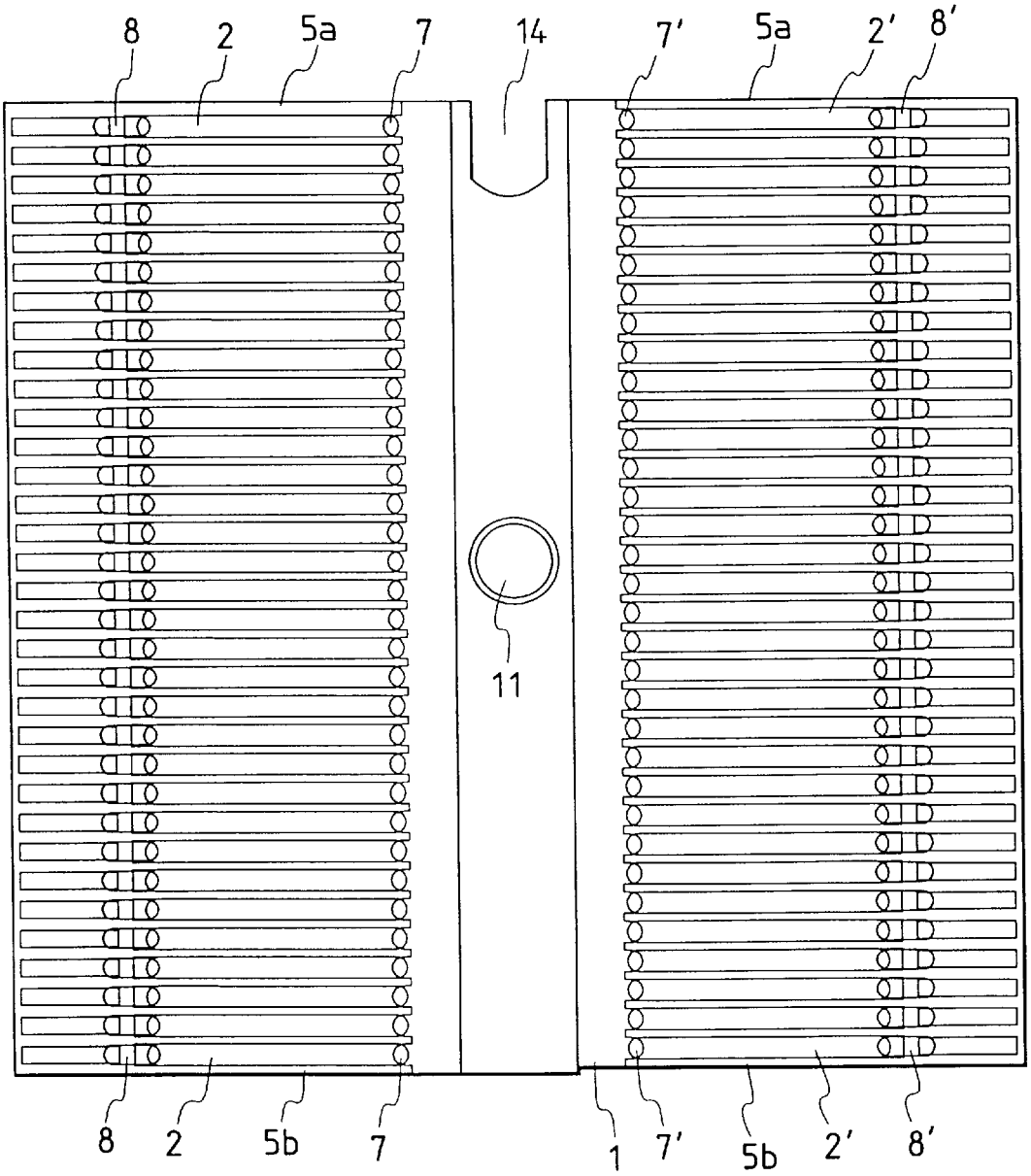
FIG. 1 is a top view showing an embodiment of the invention.

Details of the invention will now be described with reference to the embodiments shown in the drawings.

Figure 2A:
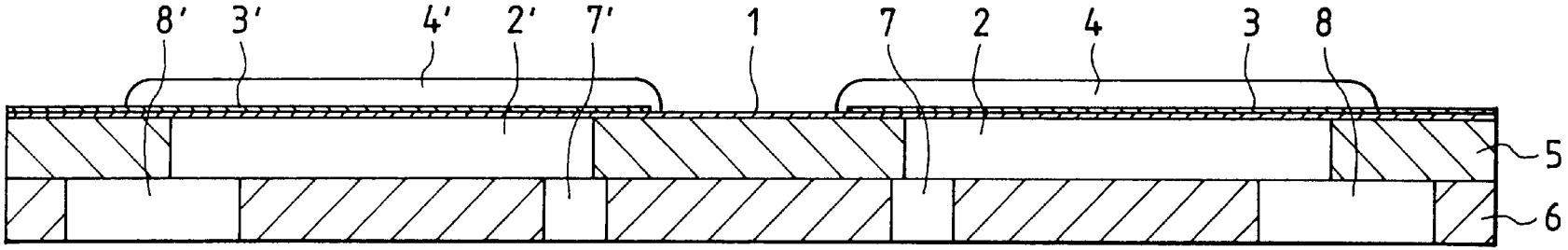
FIGS. 2(*a*) and 2(*b*) are sectional views showing the embodiment of the invention in the form of a structure in the vicinity of pressure generating chambers of a single actuator unit.
Figure 2B:
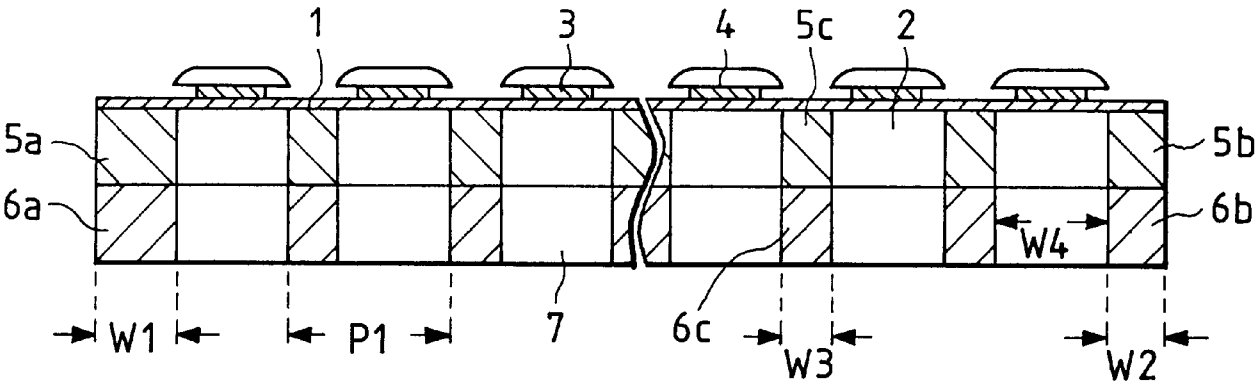

FIGS. 1 and 2 show an embodiment of the invention. In FIGS. 1 and 2, reference numeral 1 denotes a first cover plate, which comprises a thin zirconia plate having a thickness of about 9 $\mu$m and has drive electrodes 3, 3' formed on a surface thereof in such a manner that the drive electrodes 3, 3' confront pressure generating chambers 2, 2' that will be described later. Piezoelectric vibrators 4, 4' made of PZT or the like are deposited on the drive electrodes 3. 3'.

Reference numeral 5 denotes a spacer that defines the pressure generating chambers 2, 2'. The spacer 5 has through holes that will serve as the pressure generating chambers 2, 2' in such a manner that the through holes are arranged at a pitch equal to or less than a pitch P2. The pitch P2 is a pitch at which nozzle openings 30, 30' of a flow path unit 20, which will be described later, are arranged. The spacer 5 is also designed so that a width W3 of a partition wall 5*c* that defines one pressure generating chamber 2 from another pressure generating chamber 2' will become about ⅓ the width of each of the pressure generating chambers 2. 2'.

Reference numeral 6 denotes a second cover body. On sides of the second cover body 6 toward which the pressure generating chambers 2, 2' confront each other are ink jetting outlets 7, 7' and on the sides thereof opposite to such sides are ink flowing inlets 8, 8'. The ink jetting outlets 7, 7' and the ink flowing inlets 8, 8' are formed so as to communicate with the pressure generating chambers 2, 2'.

By the way, partition walls 5*a*, 5*b* positioned on both outermost ends of the spacer 5 as well as partition walls 6*a*, 6*b* on both outermost ends of the second cover body 6 are adequately rigid even if width W1, W2 thereof are set to a value substantially equal to the width W3 of the partition wall 5*c* of the spacer 5 and of a partition wall 6*c* of the second cover body 6 that are formed inside. Therefore, the widths W1, W2 are set to values substantially equal to or more than the width W3 of the partition wall 5*c* of the pressure generating chamber 2 and substantially equal to or less than ½ a pitch P1 at which the pressure generating chambers 2 are arranged. Hereupon, the width W1 may be equal to the width W2 or W1 is less or more than the W2.

These members 1, 5, 6 are assembled to an actuator unit 10 by molding a clay-like ceramic material into predetermined shapes and laminating and sintering the molded shapes without using an adhesive.

The actuator unit 10 has a positioning through holes 11 and a positioning through recess in the middle in order to facilitate the assembling operation.

Figure 3:
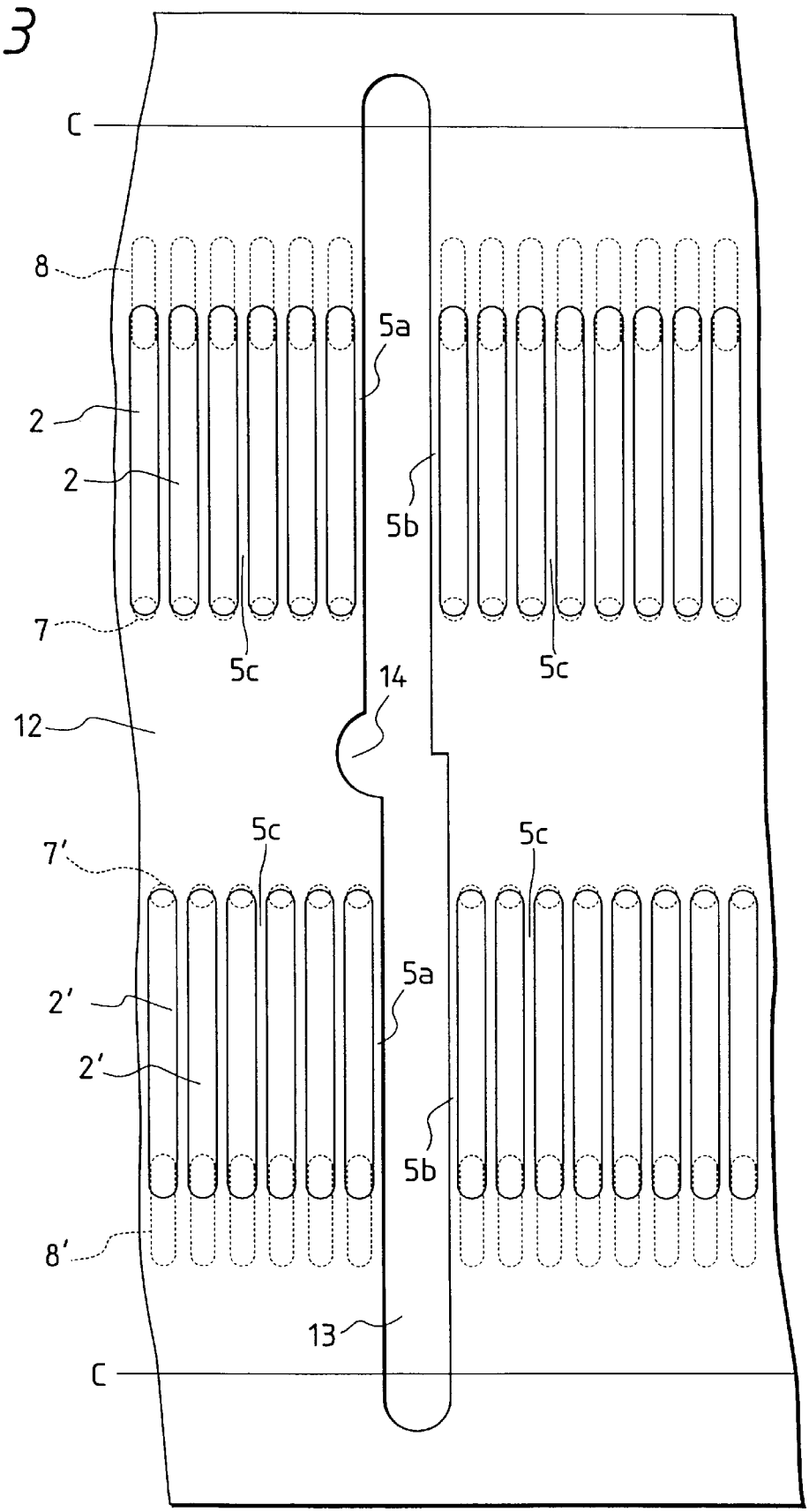
FIG. 3 is a diagram showing an exemplary method of fabricating a spacer constituting the actuator unit.

When the spacer 5 that needs such thin partition walls 5*a*, 5*b*, 5*c* is to be formed of a green sheet 12 made of ceramic material, a groove 13 that extends as far as cutting lines C, C is formed along a boundary region so as to match the forming of the through holes serving as the pressure generating chambers 2 as shown in FIG. 3.

Upon completion of sintering after drying the green sheet 12, the both end portions of the sintered sheet 12 are cut away along the cutting lines C which traverse both ends of the groove 13, so that the widths W1, W2 of the partition walls 5*a*, 5*b* of the pressure generating chambers 2, 2' positioned toward both outermost ends can be formed with the same accuracy as that of the width W3 of the partition wall 5*c* that defines the pressure generating chambers 2.

Figure 4:
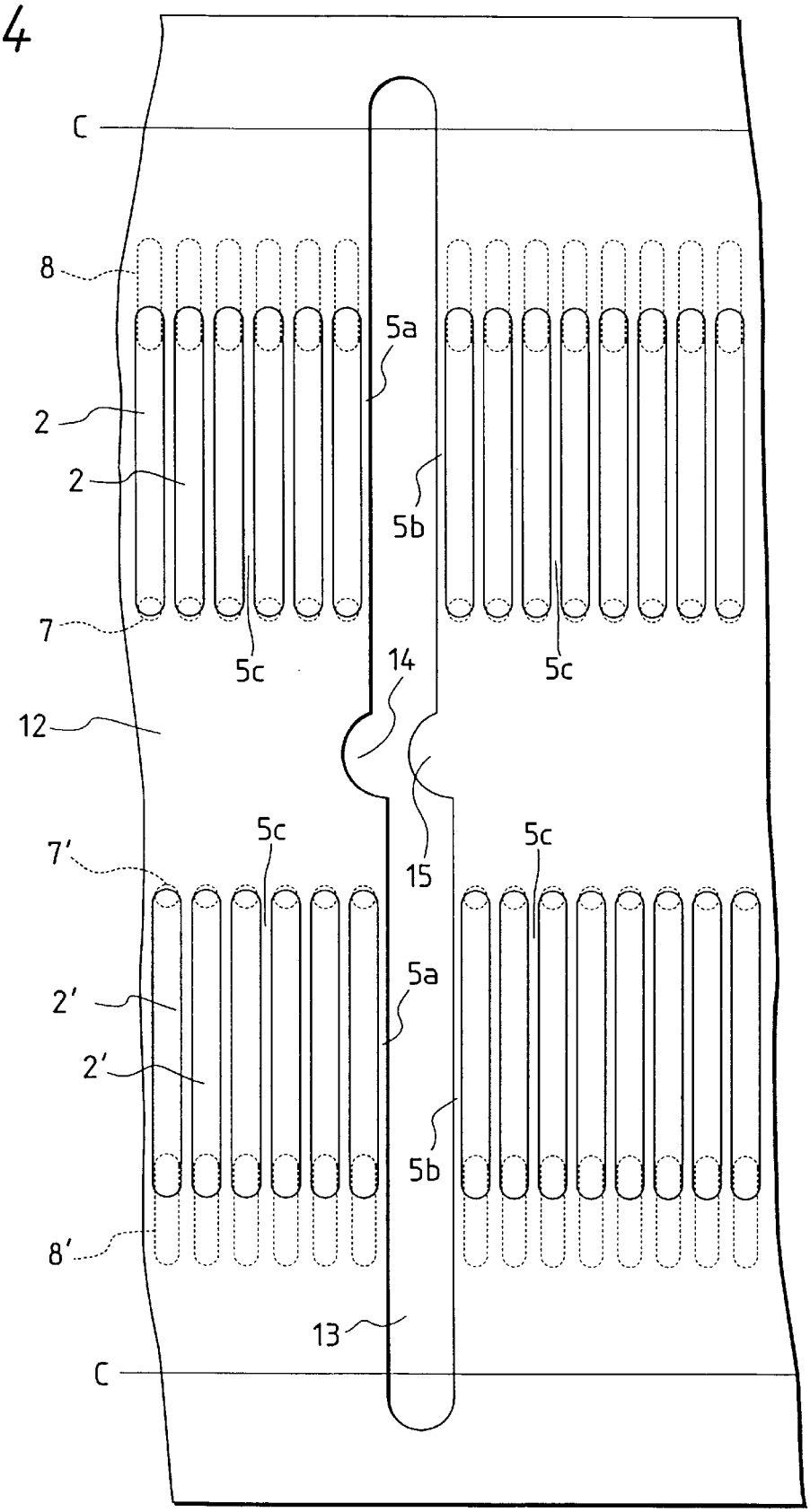
FIG. 4 is a diagram showing another exemplary method of fabricating a spacer constituting the actuator unit.
Figure 5:
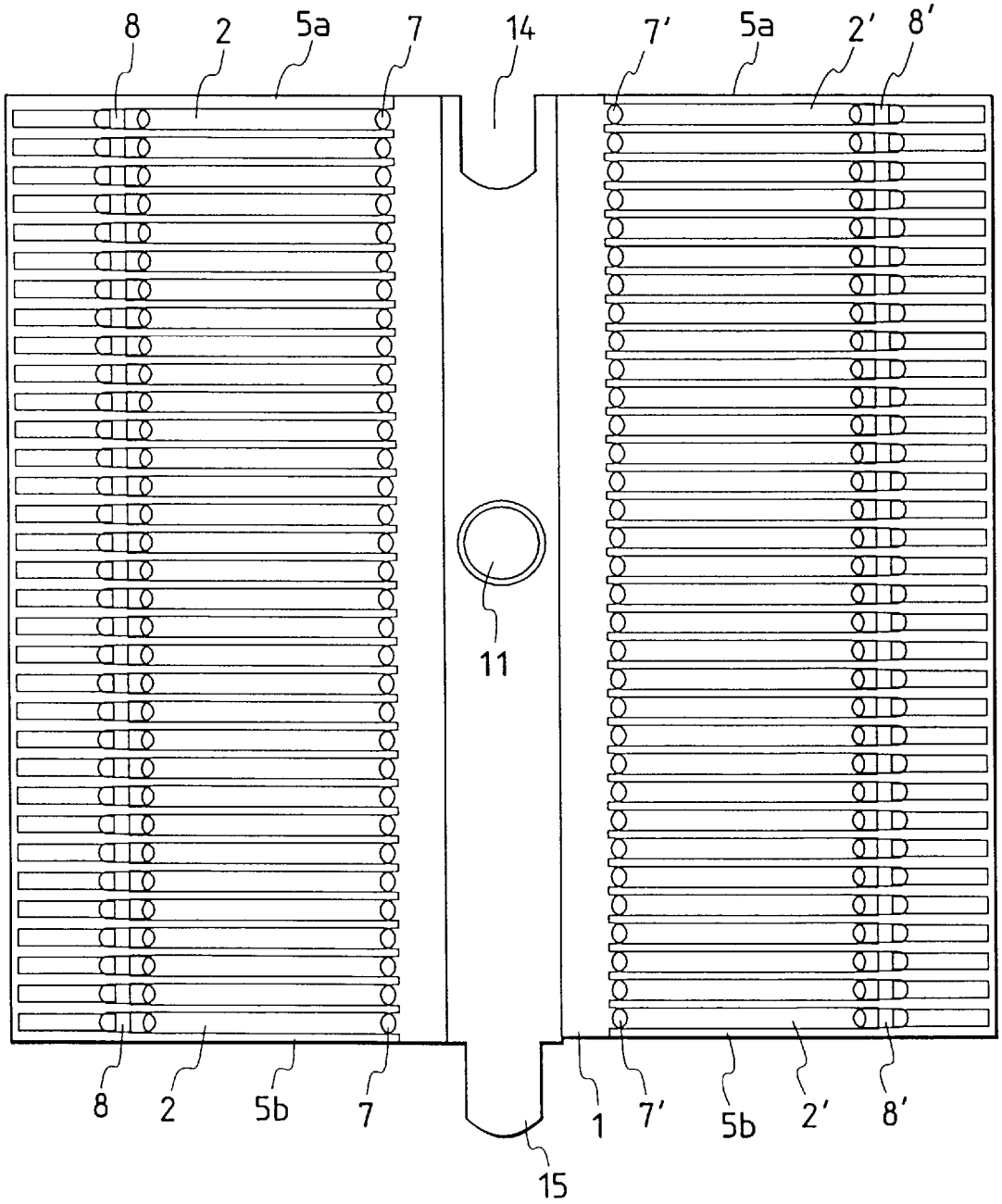
FIG. 5 is a top view showing an exemplary actuator unit fabricated by the aforementioned method.

It may be noted that by forming a projection 15 so as to coincide with the positioning through recess 14 on the other end as shown in FIG. 4 so that an actuator unit having the through recess 14 and the projection 15 can be prepared as shown in FIG. 5. The thus constructed actuator unit is advantageous in allowing two actuator units to be positioned relative to each other with ease when each actuator unit is to be set in a flow path unit.

Figure 6:
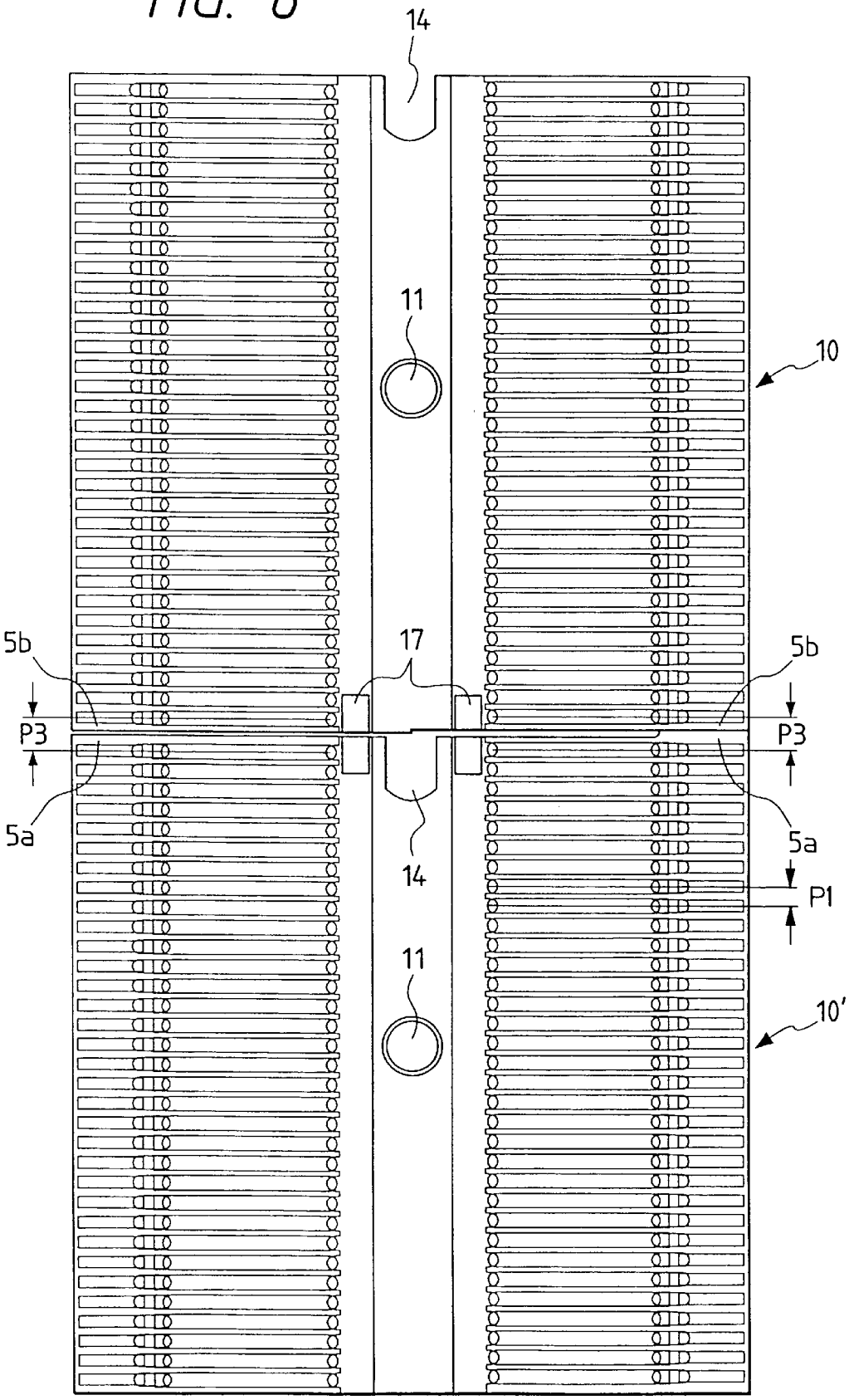
FIG. 6 is a top view showing an embodiment of the invention when a recording head is formed using two actuator units.
Figure 7A:
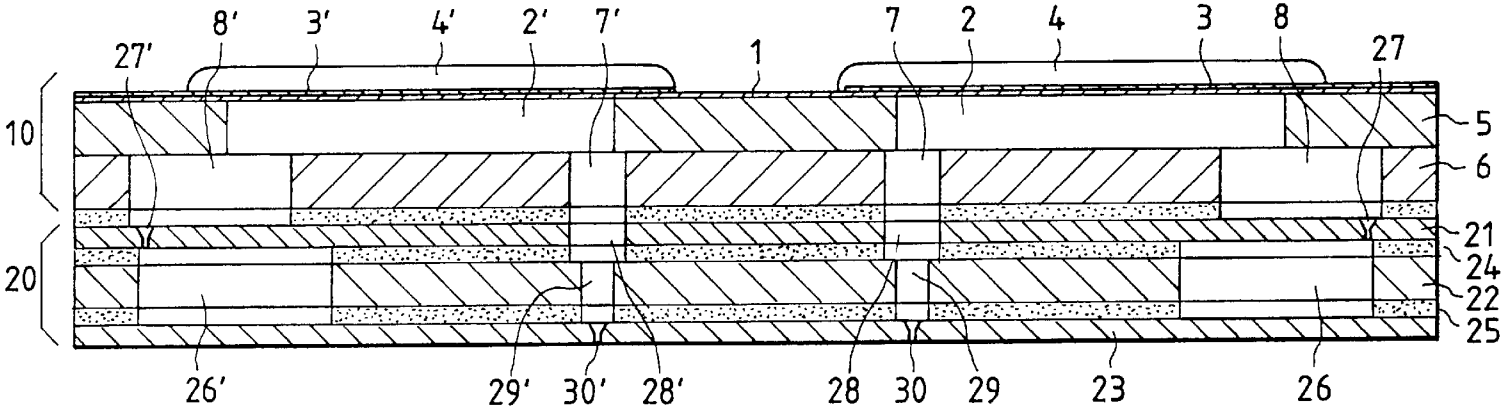
FIGS. 7(*a*) and 7(*b*) are sectional views showing how nozzle openings and pressure generating chambers are connected around where the actuator units are connected to each other.
Figure 7B:
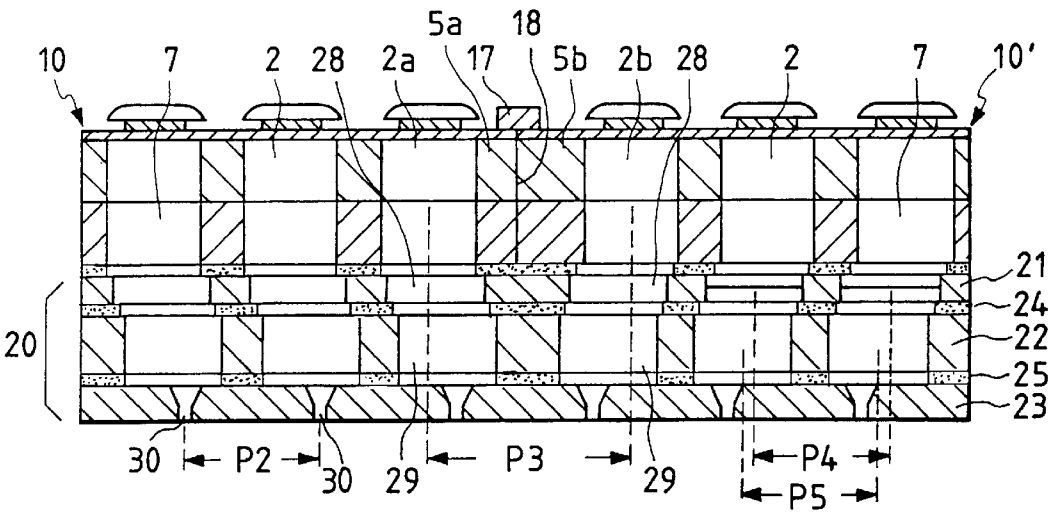

As shown in FIGS. 6, 7(*a*) and 7(*b*), the flow path unit 20 is fixed to the thus constructed two actuator units 10, 10' by bringing outermost side walls 5*b*, 5*b* into contact with corresponding outermost side walls 5*a*, 5*a* and reinforcing the flow path unit 20 and two actuator units 10, 10' with fixing members 17, 17 so as to allow the fixing members 17, 17 to mount over a contact line 18. As a result, a recording head having the two actuator units 10, 10' arranged on a straight line in tandem can be completed.

In this case, as shown in FIGS. 7(*a*) and (*b*), the partition walls 5*b*, 5*a* of the respective actuator units 10, 10' confront one another at portions where the two adjacent pressure generating chambers 2*a*, 2*b* that are in contact with the contact line 18 are partitioned, the contact line 18 being a line with which the two actuator units 10, 10' come into contact. Therefore, the partition walls 5*b*, 5*a* are about twice as thick as each partition wall 5*c* that partitions other pressure generating chambers 2.

However, by slightly shifting nozzle communication holes 28, 29 of the flow path unit 20 toward the nozzle openings 30, these pressure generating chambers 2, 2, 2*a*, 2*b* can be made to communicate with the nozzle openings 30, 30' that are arranged at the predetermined pitch P2.

The flow path unit 20 to which these actuator units 10, 10' are fixed is formed by laminating an ink supply inlet forming substrate 21, a common ink chamber forming substrate 22, and a nozzle plate 23 with adhesive layers 24, 25 such as thermally fusible films.

Ink supply inlets 27, 27' that not only connect common ink chambers 26, 26' to the pressure generating chambers 2, 2' but also serve as constrictions that utilize pressure effectively, are formed in the ink supply inlet forming substrate 21. The nozzle communication holes 28, 28' that introduce ink from the pressure generating chambers 2, 2' into the nozzle openings 30, 30' are also formed in the ink supply inlet forming substrate 21.

Further, the common ink chamber forming substrate 22 is prepared by forming the common ink chambers 26, 26' and nozzle communication holes 29, 29'. The common ink chambers 26, 26' receive the ink from a not shown ink tank and distribute the received ink to the respective pressure generating chambers 2, 2'. The nozzle communication holes 29, 29' connect the pressure generating chambers 2, 2' to the nozzle openings 30, 30.

The nozzle plate 23 is prepared by forming the nozzle openings 30, 30' so as to be arranged on a single line at the predetermined pitch P2.

As described above, the distance between the two pressure generating chambers 2*a*, 2*b* located at the boundary at which the two actuator units 10, 10' are connected to each other is substantially twice the width of the partition wall 5*c* that defines the respective pressure generating chambers 2, 2 since the partition wall 5*a* abuts on the partition wall 5*b*. That is, a distance P3 between the pressure generating chambers 2*a*, 2*b* is larger than the distance P1 between other pressure generating chambers 2, 2.

However, by forming the nozzle communication holes 28, 28' of the ink supply inlet forming substrate 21 and the nozzle communication holes 29, 29' of the common ink chamber forming substrate 22 so as to shift slightly toward the contact line 18, these pressure generating chambers 2*a*, 2*b* can be connected to each other without causing ink droplets to be jetted out into the nozzle openings 30, 30 at all times, i.e., without letting the ink stagnate in the nozzle openings 30, 30.

Specifically, if the pressure generating chambers 2, 2' are arranged at a pitch P1 of about 4/360 inches, then the width W3 of the partition wall 5*c* defining the pressure generating chambers 2 can be set to about 1/360 inches and this allows the distance P3 between the two pressure generating chambers 2*a*, 2*b* interposing the contact line 18 therebetween to be set to about 6/360 inches. That is, the distance P3 becomes wider merely by about 2/360 inches than the pitch P1 of the pressure generating chambers 2, 2' other than the outermost pressure generating chambers.

If the nozzle communication holes 28, 28' of the ink supply inlet forming substrate 21 and the nozzle communication holes 29, 29' of the common ink chamber forming substrate 22 of the flow path unit 20 are arranged so as to position toward the contact line 18, the ink can be driven out of the nozzle openings 30 smoothly without stagnation in the pressure generating chambers 2, 2' since steps between the upper and lower communication holes 28, 29, 28', 29' are reduced.

As a result, a plurality of actuator units 10 can be arranged in tandem on a straight line with respect to the nozzle openings 30, 30 pitched at a predetermined interval so as to communicate with the nozzle openings 30, 30.

Figure 8:
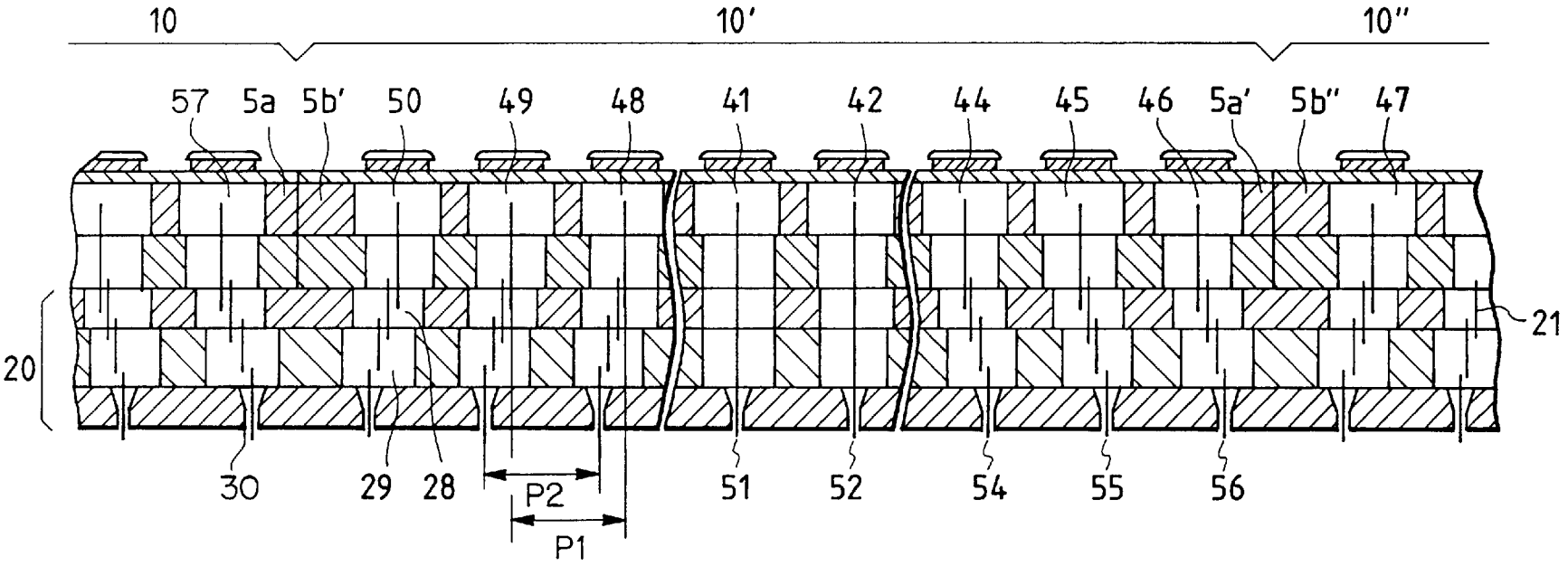
FIG. 8 is a sectional view showing a laminated ink jet recording head, which is an embodiment of the invention, the recording head being formed using three actuator units of the invention.

While the case where the recording head is constructed by connecting two actuator units in tandem has been described in the aforementioned embodiment, a recording head may be constructed by connecting three or more actuator units 10, 10', 10" to the flow path unit 20 having nozzle openings at the predetermined pitch P2 by making the pitch P1 at which the pressure generating chambers are arranged slightly smaller than the pitch P2 at which the nozzle openings 30 formed in the flow path unit 20 are arranged as shown in FIG. 8.

That is, assuming that the nozzle arrangement pitch is P2, that the distance between the ends of the adjacent actuator units is P3, and that the number of pressure generating chambers in a single row of a single actuator unit is N, then the pressure generating chamber arrangement pitch P1 may be set as follows.

$$P1=P2-(P3-P2)/(N-1)$$

The pressure generating chambers in the middle of the actuator units 10, 10', 10", e.g., pressure generating chambers 41, 42 of the actuator unit 10' in the middle are positioned on vertical lines of nozzle openings 51, 52 to which such pressure generating chambers 41, 42 are to be connected, whereas the pressure generating chambers 44, 45, 46 positioned on a right side of the pressure generating chambers 42 in FIG. 8 are gradually deviated from the centerlines of nozzle openings 54, 55, 56 to which the pressure generating chambers 44, 45, 46 are to be connected.

However, if the nozzle opening arrangement pitch P2 is set to 4/360 inch as described above and the number of nozzle openings in a row to which the actuator units 10, 10', 10" are connected is set to 32, then a displacement between the nozzle opening arrangement pitch P2 and the pitch P1 at which the pressure generating chamber 2, 2' are arranged is about 4.6 $\mu$m. Therefore, if the pitch P4 at which the nozzle communication holes 28, 28, 28 . . . of the ink supply inlet forming substrate 21 and a pitch P5 at which the nozzle communication holes 29, 29, 29 . . . of the common ink chamber forming substrate 22 are given as $$P4=P2-2(P3-P2)/3(N-1)$$

$$P5=P2-(P3-P2)/3(N-1),$$

then, ink is allowed to flow smoothly from the pressure generating chambers 2 to the corresponding nozzle openings 30.

By making the pressure generating chamber arrangement pitch P1 slightly smaller than the nozzle opening arrangement pitch P2, the pressure generating chambers located in the middles of the actuator units 10, 10', 10" are caused to communicate with the nozzle openings substantially straight. Further, if the communication holes of the flow path unit 20 are gradually shifted slightly toward a side end, an increase in the thickness due to the two partition walls 5*a*', 5*b*" of the two pressure generating chambers 46, 47 and due to the two partition walls 5*a* and 5*b*' of the pressure generating chambers 50, 57 can be absorbed merely by shifting the positions of the communication holes of the flow path units confronting the actuator units within the ranges of the regions in which the respective actuator units confront. Therefore, four or more actuator units can be connected in tandem.

While the case where a plurality of actuator units are connected in a row has been described in the aforementioned embodiment, it is apparent that an ink jet recording head for a multi-nozzle color printer can be constructed simply by arranging a number of actuator units in tandem in a carriage moving direction.

Figure 9:
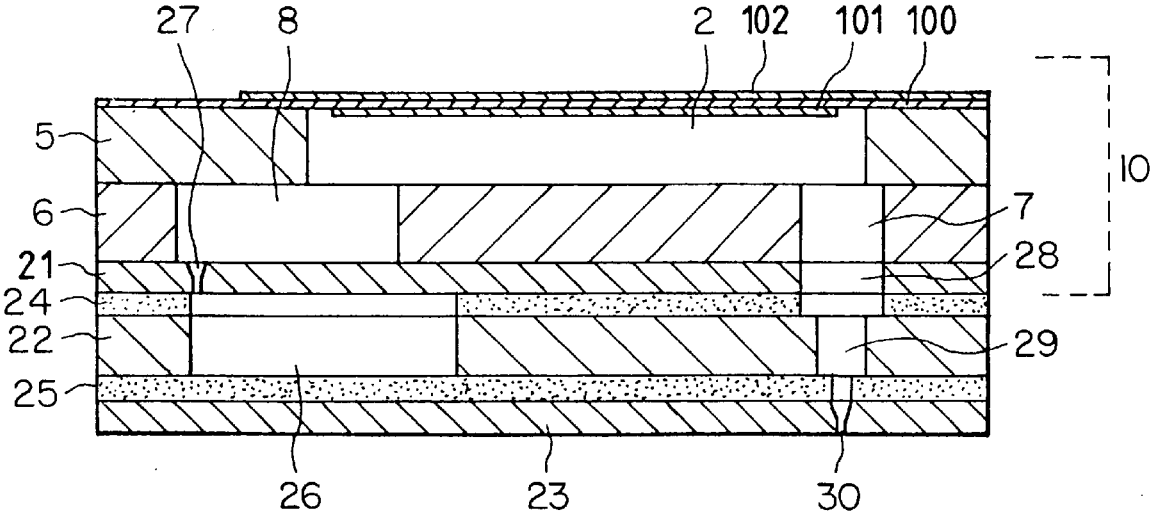
FIG. 9 is a sectional view showing pressure generating chambers and related portions thereof in one actuator unit in another embodiment of the ink jet print head of the invention.
Figure 10:
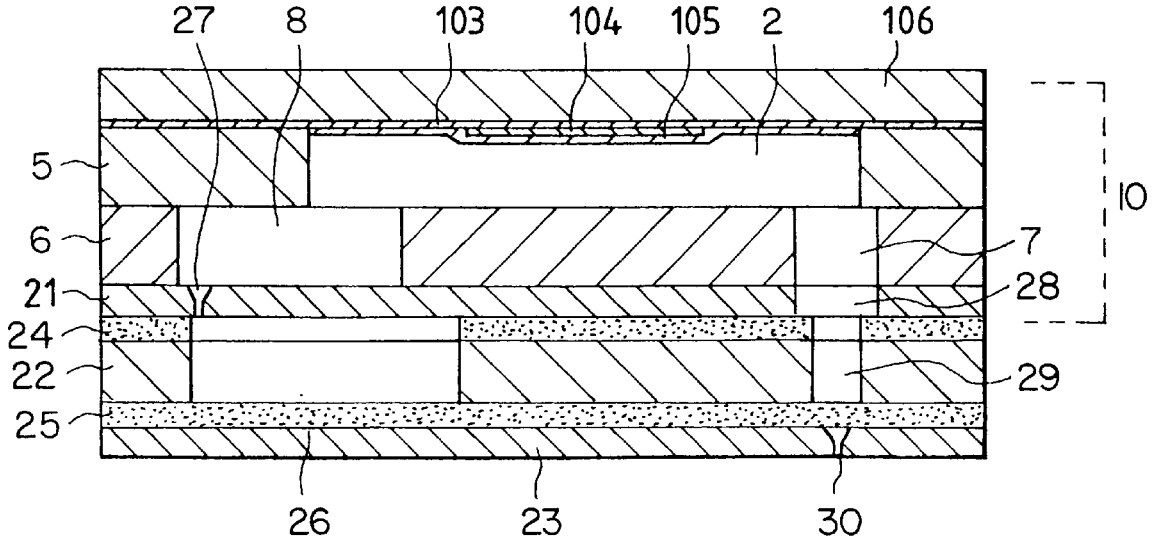
FIG. 10 is a sectional view showing pressure generating chambers and related portions thereof in one actuator unit in still another embodiment of the ink jet print head of the invention.
Figure 11:
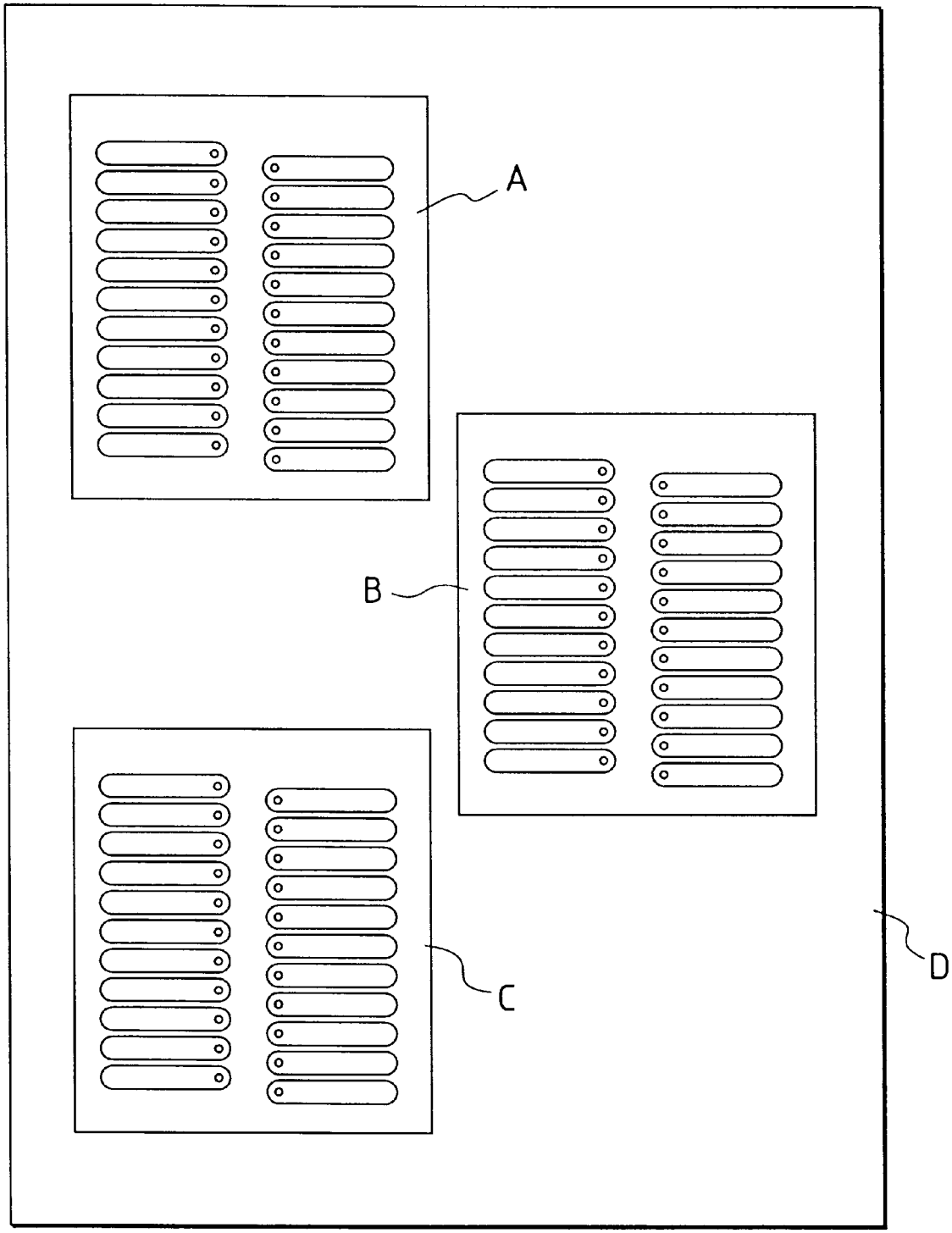
FIG. 11 is a diagram showing an example of a laminated ink jet recording head.

In the aforementioned actuator unit, the pressure generating portion comprises the first cover plate 1, the piezoelectric vibrators 4 and the drive electrodes 3 as shown in FIGS. 1 and 2. Alternatively, the pressure generating portion which comprises piezoelectric vibrating plates 100, lower electrodes 101 and upper electrodes 102 so as to seal a surface of the space may be applied as shown in FIG. 9. Furthermore, the pressure generating portion comprising cover plates 106, electrically conductive layer 103, heating elements 104 and protective layer 105 may be used as shown in FIG. 10. Other constitutions which make the pressure in the pressure generating chamber change may be used for the present invention.

As described in the foregoing, the invention is characterized in that an actuator unit for a laminated ink jet recording head, a plurality of actuator units being brought into contact with each other at ends thereof and laminated on a flow path unit including nozzle openings, comprising: a first cover member having piezoelectric vibrators on the surface thereof; a spacer for forming pressure generating chambers, one surface thereof being sealed by the first cover member; and a second cover member laminated on the spacer and having ink jetting outlets communicating with one end of the pressure generating chambers and ink flowing inlets communicating with the other end of the pressure generating chambers; wherein a pitch at which the pressure generating chambers are arranged is set equal to or less than a pitch at which the nozzle openings are arranged and the width of partition walls on an outermost ends of the pressure generating chambers located at the outermost ends of the actuator is set equal to or more than a width of a partition wall defining adjacent pressure generating chambers and equal to or less than ½ the nozzle opening arrangement pitch. That is, the recording head provided with the actuator unit has a great number of nozzle openings on a single straight line and such recording head can be fabricated with a high yield. In addition, the width of a color printing recording head can be reduced.

What is claimed is:

1. An ink jet recording head comprising:

at least two actuator units each including a plurality of pressure generating chambers arranged in rows and means for pressurizing respectively said plurality of pressure generating chambers; and a flow path unit including nozzle openings communicating, respectively, with said pressure generating chambers, wherein said at least two actuator units contact each other at ends thereof and extend in a straight line in a direction in which said pressure generating chambers are arranged in rows, the pressure generating chambers in said at least two actuator units lying in a single plane, and a pitch at which said pressure generating chambers are arranged is set equal to or less than a pitch at which said nozzle openings are arranged, and the width of partition walls at the ends of said actuator units is set equal to or more than the width of the partition walls separating adjacent pressure generating chambers in each of the actuator units and equal to or less than ½ the pitch at which said nozzle openings are arranged.

2. The ink jet recording head according to claim 1, wherein P1 represents the pitch at which said pressure generating chambers are arranged, and P1 is expressed as follows:

$$P1=P2-(P3-P2)/(N-1);$$

wherein P2 is the pitch at which said nozzle openings are arranged, P3 is a pitch between a pressure generating chamber at the end of one actuator unit and another, adjacent pressure generating chamber at the end of another actuator unit that is contacted with said one actuator unit, and N is a number of pressure generating chambers in one row in one actuator unit.

3. The ink jet recording head according to claim 1, wherein the pitch at which said pressure generating chambers are arranged is substantially equal to 4/360 inches and the width of the partition walls separating adjacent pressure generating chambers in each actuator unit is substantially equal to 1/360 inches.

4. The ink let recording head according to claim 1, wherein at least one of said actuator units comprises a positioning through recess on one end of said at least one of said actuator units in the direction in which said pressure generating chambers are arranged in rows.

5. The ink jet recording head according to claim 1, wherein at least one of said actuator units comprises a positioning through recess on one end of said at least one of said actuator units in the direction in which said pressure generating chambers are arranged in rows, and a projection on an opposite end of said at least one of said actuator units, said projection being shaped to fit in said positioning through recess.

6. The ink jet recording head according to claim 1, further comprising:

a first cover member and piezoelectric vibrators formed on a surface of said first cover member;

a spacer that defines said pressure generating chambers and said partition walls, said spacer having one surface that is sealed by said first cover member; and a second cover member laminated on another surface of said spacer and having ink jetting outlets communicating with one end of said pressure generating chambers and ink flowing inlets communicating with another end of said pressure generating chambers.

7. The ink jet recording head according to claim 6, wherein said flow path unit comprises:

an ink supply inlet forming substrate for forming ink supply inlets communicating with said ink flowing inlets and first nozzle communication holes communicating with said ink jetting outlets;

a common ink chamber forming substrate for forming a common ink chamber and second nozzle communication holes communicating with said first nozzle communication holes; and a nozzle plate for forming said nozzle openings.

8. The ink jet recording head according to claim 7, wherein P1 represents the pitch at which said pressure generating chambers are arranged, and P1 is expressed as follows:

$$P1=P2-(P3-P2)/(N-1);$$

and a pitch P4 at which said first nozzle communication holes are arranged and a pitch P5 at which said second nozzle communication holes are arranged are expressed as follows:

$$P4=P2-2(P3-P2)/3(N-1),$$

$$P5=P2-(P3-P2)/3(N-1);$$

wherein P2 is the pitch at which said nozzle openings are arranged, P3 is a pitch between a pressure generating chamber at the end of one actuator unit and another, adjacent pressure generating chamber at the end of another actuator unit that is contacted with said one actuator unit, and N is a number of pressure generating chambers in one row in one actuator unit.

9. The ink jet recording head according to claim 7, further comprising at least one fixing member mounted on adjacent ones of said actuator units.

10. An ink jet recording head as recited in claim 1, wherein said flow path unit comprises a common ink chamber that extends continuously from one actuator unit to an adjacent actuator unit.

* * * * *